US005091609A

United States Patent [19]

Sawada et al.

[11] Patent Number: 5,091,609

[45] Date of Patent: Feb. 25, 1992

[54] INSULATED WIRE

[75] Inventors: Kazuo Sawada; Shinji Inazawa; Kouichi Yamada, all of Osaka, Japan

[73] Assignee: Sumitomo Electric Industries, Ltd., Osaka, Japan

[21] Appl. No.: 598,629

[22] PCT Filed: Feb. 13, 1990

[86] PCT No.: PCT/JP90/00177

§ 371 Date: Oct. 12, 1990

§ 102(e) Date: Oct. 12, 1990

[87] PCT Pub. No.: WO90/09670

PCT Pub. Date: Aug. 23, 1990

[30] Foreign Application Priority Data

Feb. 14, 1989 [JP] Japan ..... 1-34526
Jan. 31, 1990 [JP] Japan ..... 2-22854

[51] Int. Cl.[5] ..... H01B 7/02; H01B 3/10

[52] U.S. Cl. ..... 174/110 A; 174/126.2; 427/123; 427/126.4; 428/384

[58] Field of Search ..... 174/110 A, 126.2; 428/375, 378, 384, 388; 427/123, 126.2, 126.3, 126.4

[56] References Cited

U.S. PATENT DOCUMENTS 2,088,949 8/1937 Fekete ..... 174/110 A
3,961,111 6/1976 Smith, deceased ..... 427/419
4,288,299 9/1981 Carter ..... 204/38.3 X
4,417,097 11/1983 Das ..... 174/110 A
4,483,751 11/1984 Murayama et al. ..... 204/37.6
4,620,086 10/1986 Ades et al. ..... 174/110 A
4,738,896 4/1988 Stevens ..... 428/378 X

FOREIGN PATENT DOCUMENTS 188369 7/1986 European Pat. Off. .
188370 7/1986 European Pat. Off. .
51-93976 7/1976 Japan .
56-149775 11/1981 Japan .
165909 7/1986 Japan .
165910 7/1986 Japan .
63-239150 10/1988 Japan .
63-247374 10/1988 Japan .
63-279524 11/1988 Japan .

*Primary Examiner*—Morris H. Nimmo
*Attorney, Agent, or Firm*—W. G. Fasse; D. H. Kane, Jr.

[57] ABSTRACT

An insulated electrical wire is suitable for use as a distribution wire, a wire for winding coils, and for other electrical purposes. The wire can be used in a high-vacuum environment or in a high-temperature environment. This insulated electrical wire has a conductor core made of a base material (1), an anodic oxide layer (2), and an oxide insulating layer (3). The base material (1) forms a conductor core and has a surface cover of either an aluminum layer or an aluminum alloy layer at least on its outer surface. The anodic oxide layer (2) is formed on the surface layer. The oxide insulating layer (3) is formed on the anodic oxide layer by a sol-gel method or an organic acid salt pyrolytic method. This insulated electrical wire has a good heat resistance and a good insulating strength as well as excellent flexibility, and does not provide any gas adsorption source.

10 Claims, 1 Drawing Sheet

INSULATED WIRE

FIELD OF THE INVENTION

The present invention relates to an insulated electrical wire, and more particularly, it relates to an insulated wire such as a distribution wire, a wire for winding coils or the like which is employed in a high-vacuum-environment or in a high-temperature environment as may prevail in a high-vacuum apparatus or in a high-temperature service apparatus.

BACKGROUND INFORMATION

An insulated electrical wire may be used in equipment such as heating equipment or in a fire alarm device for which safety under a high temperature is required. Further, an insulated wire of this type is also used in the environment of an automobile, which is heated to a high temperature by the engine. An insulated wire formed by an electrical conductor which is coated with heat resistant organic resin such as polyimide, fluorocarbon resin or the like has generally been used for the above purposes.

Mere organic coatings are insufficient for applications requiring a high heat resistance or for use in a environment for which a high degree of vacuum is required, because an organic coating has an insufficient heat resistance, and due to a gas emission property and the like. Thus, an insulated wire having a conductor inserted in an insulator tube of ceramics, or an MI cable (Mineral Insulated Cable) having a conductor inserted in a heat resistant alloy tube of a stainless steel alloy etc. which is filled with metal oxide powder of magnesium oxide etc., or the like has been used in high temperature and vacuum environments.

A fiber-glass braided insulated wire employing textile glass fiber as an insulating member etc. is listed as an insulated wire satisfying flexibility and heat resistance requirements.

In the aforementioned insulated wire coated with a heat-resistant organic resin, the highest temperature at which an adequate electric insulation can be maintained, is about 200° C. at the most. Therefore, it has been impossible to use such an organic insulation coated wire under conditions requiring a guarantee of an adequate electrical insulation at a high temperature of at least 200° C.

Further, the insulated wire which is improved in its heat resistance by an insulator tube of ceramics, has disadvantages such as an inferior flexibility. The MI cable comprising a heat resistant alloy tube surrounding a conductor, has an increased outer diameter with respect to the conductor radius. Thus, the MI cable has a relatively large cross-section with respect to electric energy that can be carried by the conductor passing through the heat resistant alloy tube. In order to use the MI cable as a wire for winding a coil in a bobbin or the like, however, it is necessary to bend the heat resistant alloy tube in a prescribed curvature which is difficult. For example, it is difficult to obtain a suitable winding density since the tube forming the outer enclosure is thick compared to the conductor.

Further, when the fiber-glass braided, heated resistant, insulated wire is employed and worked into a prescribed configuration as required for its application, the network of the braid is disturbed resulting in a breakdown. In addition, dust of glass is generated by the glass fibers. This glass dust may serve as a gas adsorption source. Therefore, when the fiber-glass braided insulated wire is used in an environment for which a high degree of vacuum is required, it has been impossible to maintain a high degree of vacuum due to the gas adsorption source by the glass dust.

SUMMARY OF THE INVENTION

Accordingly, the present invention has been proposed in order to solve the aforementioned problems, and its object is to provide an insulated electrical conductor wire comprising the following features:

(a) It has a high electrical insulating strength under a high temperature operating conditions, (b) it has an excellent flexibility, and (c) it does not comprise any gas adsorption source.

An insulated wire according to one aspect of the present invention comprises a base material, an anodic oxide film, or said base material and an oxide insulating layer or said anodic oxide film. The base material includes an electrical conductor, and has a surface layer of either an aluminum layer or an aluminum alloy layer at least on its outer surface. The oxide insulating layer is formed on the anodic oxide layer by a sol-gel method.

When the base material is worked into a composite conductor, a material containing either copper or a copper alloy is used by way of example, for the core of the base material. In this case, the base material is preferably prepared by a pipe cladding method. The oxide insulating layer preferably contains at least either silicon oxide or aluminum oxide.

An insulated wire according to another aspect of the present invention comprises a base material, an anodic oxide layer, on the base material and an oxide insulating layer on the oxide layer. The base material includes a conductor, and has a surface layer of either an aluminum layer or an aluminum alloy layer at least on its outer surface. The oxide insulating layer is formed on the anodic oxide layer by an organic acid salt pyrolytic method.

The core of the base material may contain either copper or a copper alloy. In this case, the base material is preferably prepared by a pipe cladding method. The organic insulating layer preferably contains at least either silicon oxide or aluminum oxide.

The oxide insulating layer of the present invention is formed by applying a solution containing a ceramics precursor, onto the anodic oxide layer and thereafter completely bringing the ceramics precursor into a ceramics state. The solution containing the ceramics precursor is a solution of a metal organic compound of high polymers having an alkoxide group, a hydroxy group and metalloxan bonding, which is generated by hydrolysis and a dehydration/condensation reaction of a compound having a hydrolyzable organic group such as a metal alkoxide, and contains an organic solvent such as alcohol, the metal alkoxide of the raw material, a small amount of water, and a catalyst which are required for the hydrolysis. In another embodiment the oxide insulation layer is formed of a solution which is obtained by mixing or dissolving metal organic compounds in a proper organic solvent. Further, the metal organic compounds mentioned herein exclude those in which elements directly bonded to the metal atoms are all carbon. Stated differently, the metal organic compounds employed in the present invention are restricted to those having thermal decomposition temperatures lower than the boiling points of the metal organic compounds under atmospheric pressure, since the present metal oxide film is obtained by thermally decomposing the metal organic compounds by heating.

The above mentioned sol-gel method for the formation of the insulation oxide film, is a solution method, wherein a solution prepared by hydrolyzing and dehydrating or condensing metal alkoxide is applied onto an outer surface to be coated such as a base material and thereafter treating the coated material at a prescribed temperature, thereby forming the oxide insulating layer. The film or layer formed by the sol-gel method is an oxide which is brought into a ceramics state. This oxide is preferably formed by a heat treatment in an atmosphere of an oxygen gas current. The oxide insulating layer thus brought into a ceramics state exhibits excellent heat resistance and insulating strength under high temperature operating conditions of at least 500° C.

In another aspect of the present invention, an anodic oxide film is formed on an aluminum layer or an aluminum alloy layer, and an insulating oxide film is formed on the anodic oxide film by an organic acid salt pyrolytic method, which is a solution method. The organic acid salt pyrolytic methods forms a metal oxide by pyrolyzing an organic acid salt, i.e., metallic salt such as naphthenic acid, capric acid, stearic acid, octylic acid or the like. A film formed by the organic acid salt pyrolytic method is an oxide which is brought into a ceramics state. This oxide is preferably formed by a heat treatment in an atmosphere of an oxygen gas current. The oxide insulating layer thus brought into a ceramics state exhibits an excellent heat resistance and insulability strength under a high temperature of at least 500° C.

The anodic oxide film strongly adheres to the aluminum layer or the aluminum alloy layer. Further, this anodic oxide film also functions to some extent as an insulator. However, the anodic oxide film has a rough surface. Therefore, the outer surface of the anodic oxide film has a large surface area, and provides a gas adsorption source. Therefore, a conductor which is formed with only an anodic oxide film on its outer surface cannot be used in a high vacuum environment.

Further, the anodic oxide film is porous and has a large number of holes passing from its surface toward the base material. Thus, it is generally impossible to obtain an insulating strength which is proportional to the film thickness of the anodic oxide film.

To this end, the inventors have found that it is possible to form a film or layer for filling up the holes of the anodic oxide film and simultaneously covering the irregular surface thereby smoothing the surface, by forming an oxide film on the outer surface of the anodic oxide film through the sol-gel method or the organic acid salt pyrolytic method. Thus, it is possible to obtain a high breakdown voltage characteristics which is proportional to the film thickness, as well as to reduce the gas adsorption source by decreasing the outer surface area.

Further, the anodic oxide film adheres excellently to the aluminum layer or the aluminum alloy layer forming at least the outer surface of the base material. Thus, the adhesion between the oxide film and the outer surface of the base material is improved as compared with the case of directly forming an oxide film on the outer surface of a conductor by the sol-gel method or the organic acid salt pyrolytic method. Therefore, the insulated wire according to the present invention has a good heat resistance, a good flexibility, and a good insulating strength under high temperature operating conditions.

DETAILED DESCRIPTION OF PREFERRED EXAMPLE EMBODIMENTS AND OF THE MODES OF CARRYING OUT THE INVENTION

Example 1

(a) Formation of an Anodic Oxide Film

A pure aluminum wire having a diameter of 2 mmϕ was dipped in diluted sulfuric acid of 23 percent by weight, which was maintained at a temperature of 38° C. Thereafter a positive voltage was applied to the aluminum wire, and the outer surface of the pure aluminum wire was anodized with a bath current of 2.5 $A/dm^2$ maintained for 20 minutes. Thus, an anodic oxide film was formed on the outer surface of the pure aluminum wire with a film thickness of about 20 μm. The as obtained wire was dried in an oxygen gas current at a temperature of 500° C.

(b) Preparation of a Coating Solution Used in the Sol-Gel Method 1.2 N of concentrated nitric acid was added to a solution, which was prepared by mixing tetrabutylorthosilicate, water, and ethanol in mole ratios 8:32:60, in the ratio of 1/100 mole of tetrabutylorthosilicate. Thereafter this solution was heated and stirred at a temperature of 70° C. for two hours.

(c) Coating

The wire obtained by (a) was dipped in the coating solution of (b). A heating step was performed at a temperature of 400° C. for 10 minutes and five times on the wire outer surface of which had been coated with the coating solution. IN an initial stage of this step, a characteristic rough surface, which was formed by the anodic oxidation treatment, disappeared due to the heat treated surface which was observed with an electron microscope. The heat treatment resulted in a structure wherein the rough portions were impregnated with oxides. It has been confirmed that a film was formed on the exterior of the impregnated layer by repeating the heating step. Finally, this wire was heated in an oxygen gas current at a temperature of 500° C. for 10 minutes.

Figure 1:
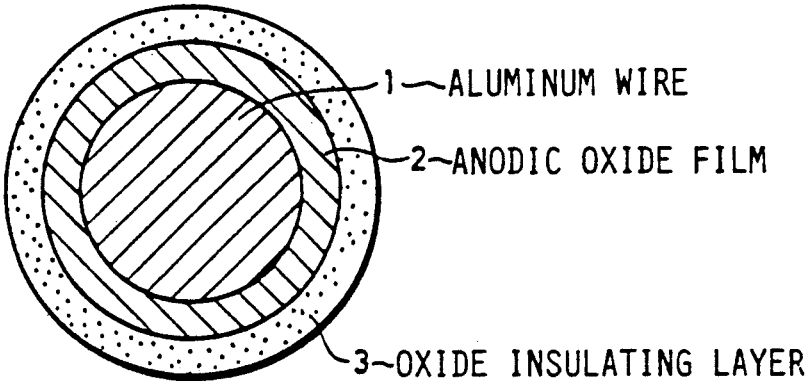
FIGS. 1 and 2 are sectional views showing cross sections of insulated wires according to the present invention corresponding to respective Examples 1 and 3 as well as 2 and 4.

An insulated coated wire obtained in the aforementioned manner is shown in FIG. 1 showing a cross sectional view of the insulated wire according to the present invention. Referring to FIG. 1, an anodic oxide film 2 is formed on the outer surface of an aluminum wire 1. An oxide insulating layer 3 is formed on this anodic oxide film 2 by the sol-gel method. In the aforementioned Example 1, this oxide insulating layer 3 is made of silicon oxide. In Example 1, the coating thickness of the insulating coating formed by the anodic oxide film 2 and by the oxide insulating layer 3 was about 40 μm.

The breakdown voltage was measured in order to evaluate the insulating strength of the insulated wire of Example 1. Its breakdown voltage was 1.6 kV at room temperature, and was 1.2 kV at a temperature of 600° C. When this insulated wire was wound onto the outer peripheral surface of a cylinder having a diameter of 5 cm, no cracking of the insulating layer occurred.

Example 2

(a) Formation of an Anodic Oxide Film

An aluminum clad copper wire having a conductivity of 84% IACS on the assumption that the conductivity of pure copper is 100, and a diameter of 1 mmϕ was used in this Example 2. Such a wire has a core of oxygen free copper (OFC) enclosed by an outer layer of aluminum (JIS nominal 1050) having a layer thickness of 100 μm. This aluminum clad copper wire was dipped in diluted sulfuric acid of 23 percent by weight which was maintained at a temperature of 30° C. Thereafter a positive voltage was applied to the aluminum clad copper clad wire, to anodize the outer surface of the aluminum layer with of a bath current of 15 A/dm$^2$ maintained for two minutes. Thus, an anodic oxide film was formed on the surface of the aluminum clad copper wire. The anodic film had a thickness of about 10 μm. The as-formed wire was dried in an oxygen gas current at a temperature of 500° C.

(b) Preparation of a Coating Solution Used in the Sol-Gel Method

Tributoxyaluminum, triethanolamine, water and ethanol were mixed in mole ratios 3:7:9:81 at a temperature of about 5° C. Thereafter this solution was heated and stirred at a temperature of 30° C. for one hour.

(c) Coating

The coating treatment of the wire was performed similar to Example 1.

Figure 2:
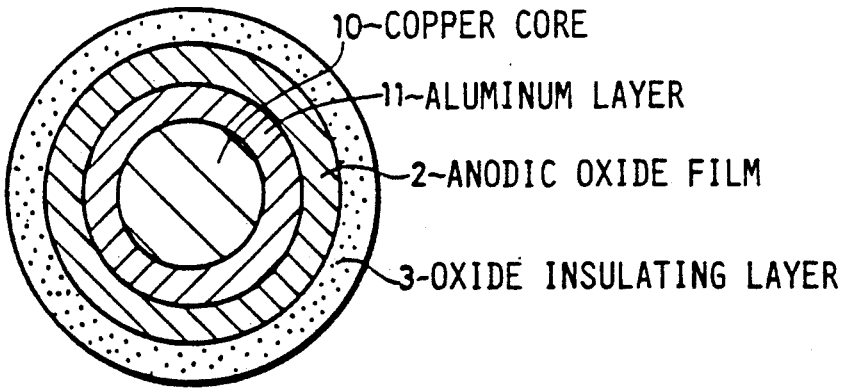

An insulated coated wire obtained in the aforementioned manner is shown in FIG. 2, showing a cross-sectional view. Referring to FIG. 2, an aluminum clad copper clad wire having an aluminum layer 11 on the outer surface of a copper core 10 was employed as a base material. An anodic oxide film 2 is formed on the outer surface of this aluminum layer 11. An oxide insulating layer 3 is formed on the anodic oxide film 2 by the sol-gel method. In the aforementioned Example 2, this oxide insulating layer 3 is of aluminum oxide. According to the aforementioned Example 2, further, the coating thickness of an insulating coating formed by the anodic oxide film 2 and by the oxide insulating layer 3 was about 20 μm.

The breakdown voltage was measured in order to evaluate the insulating strength of the insulated wire. Its breakdown voltage was 1.5 kV at room temperature, and was 1.0 kV at a temperature of 500° C. When this insulated wire was wound onto the outer peripheral surface of a cylinder having a diameter of 3 cm, no cracks occurred in the insulating layer.

Example 3

(a) Formation of the Anodic Oxide Film

A pure aluminum wire having a wire diameter of 1 mm was dipped in diluted sulfuric acid of 23 percent by weight, which was maintained at a temperature of 35° C. Thereafter a positive voltage was applied to the aluminum wire, to anodize the outer surface of the pure aluminum wire with a bath current of 5 A/dm$^2$ maintained three minutes. Thus, an anodic oxide film was formed on the outer surface of the pure aluminum wire with a film thickness of about 17 μm. The as-formed wire was dried in an oxygen gas current at a temperature of 400° C.

(b) Preparation of the coating solution Used in the Organic Acid Salt Pyrolytic Method Silicate stearate was dissolved in a mixed solution of 90 ml of toluene, 10 ml of pyridine and 6 ml of propionic acid. The concentration of this solution was so adjusted that the metal concentration of silicon was 5 percent by weight.

(c) Coating

The wire obtained as described under (a) of Example 3 was dipped in the coating solution prepared as described under (b) of Example 3. Heating steps at a temperature of 400° C. were performed ten times for 10 minutes each on the wire the outer surface of which was thus coated with the coating solution. Finally this wire was heated in an oxygen gas current at a temperature of 450° C. for 10 minutes.

An insulated coated sire obtained in the aforementioned manner is shown in FIG. 1. FIG. 1 is a sectional view of the insulated wire according to the present invention. Referring to FIG. 1, an anodic oxide film 2 is formed on the outer surface of an aluminum wire 1. An oxide insulating layer 3 is formed on this anodic oxide film 2 by an organic acid salt pyrolytic method. In the aforementioned Example 1, this oxide insulating layer 3 is of silicon oxide. According to the aforementioned Example 1, further, the coating thickness of an insulating coating formed by the anodic oxide film 2 and by the oxide insulating layer 3 was about 25 μm.

The breakdown voltage was measured in order to evaluate the insulating strength of the obtained insulated wire. Its breakdown voltage was 1.2 kV at room temperature, and was 0.8 kV at a temperature of 600° C. When this insulated wire was wound onto the outer peripheral surface of a cylinder having a diameter of 3 cm, the insulating layer did not crack.

Example 4

(a) Formation of Anodic Oxide Film

An aluminum clad copper wire having a conductivity of 89% IACS on the assumption that the conductivity of pure copper is 100, and a diameter of 1 mmϕ was used in this Example 4. Such a wire has a core of oxygen free copper (OFC) enclosed by an outer layer of aluminum (JIS nominal 1050) having a layer thickness of 83 μm. This aluminum clad copper wire was dipped in diluted sulfuric acid of 23 percent by weight, which was maintained at a temperature of 35° C. Thereafter a positive voltage was applied to the aluminum clad copper wire, to anodize the outer surface of the aluminum layer under a condition of a bath current of 3.5 A/dm$^2$ maintained for two minutes. Thus, an anodic oxide film was formed on the surface of the aluminum clad copper wire. The anodic oxide film had a thickness of about 15 μm. The so-formed wire was dried in an oxygen gas current at a temperature of 300° C.

(b) Preparation of the Coating Solution Used in the Organic Acid Salt Pyrolytic Method An O-cresol solution of aluminum octanate was prepared having a concentration so adjusted that the metal concentration of aluminum was 4 percent by weight.

(c) Coating

A coating treatment of the wire was performed similar to Example 3.

An insulated coated wire obtained in the aforementioned manner is shown in FIG. 2. FIG. 2 showing a cross sectional view. Referring to FIG. 2, an aluminum clad copper clad wire having an aluminum layer 11 on the outer surface of a copper core 10 was employed as a base material. An anodic oxide film 2 is formed on the outer surface of this aluminum layer 11. An oxide insulating layer 3 is formed on this anodic oxide film 2 by the organic acid salt pyrolytic method. So in the aforementioned Example 2, the oxide insulating layer 3 of Example 4 is also of aluminum oxide. According to the aforementioned Example 4, the coating thickness of an insulating coating formed by the anodic oxide film 2 and by the oxide insulating layer 3 was about 30 μm.

The breakdown voltage was measured in order to evaluate the insulation strength of the so-formed insulated wire. Its breakdown voltage was 1.6 kV at the room temperature, and was 1.2 kV at a temperature of 400° C. Also when this insulated wire was wound onto the outer peripheral surface of a cylinder having a diameter of 3 cm, the insulating layer did not crack.

Industrial Availability

As hereinabove described, the insulated wire according to the present invention is suitable for a distribution wire, a wire for winding etc. which is employed in a high-vacuum environment, or in a high-temperature environment such as a high-vacuum apparatus, or in a high-temperature service apparatus.

We claim:

1. An insulated electrical wire having a conductor core surrounded by insulation comprising: a conductor core, a surface layer at least on the outer surface of said conductor core, said surface layer being made of a member selected from the group consisting of aluminum and aluminum alloys, an anodic oxide layer (2) on said surface layer, said anodic oxide layer having holes and pores therein, and an oxide insulating layer (3) bonded to said anodic oxide layer, said oxide insulating layer filling said holes and pores of said anodic oxide layer, said oxide insulating layer and said anodic oxide layer forming together a composite insulating coating on said outer surface of said conductor core, said composite insulating coating having an outer smooth surface.

2. The insulated electrical wire of claim 1, wherein said conductor core is made of a material selected from the group consisting of copper and copper alloys.

3. The insulated electrical wire of claim 2, wherein said surface layer on said conductor core is prepared by a pipe cladding method.

4. The insulated electrical wire of claim 1, wherein said oxide insulating layer is made of at least one member selected from the group consisting of silicon oxide and aluminum oxide.

5. The insulated electrical wire of claim 1, wherein said oxide insulating layer is formed on said anodic oxide layer by a sol-gel method.

6. The insulated electrical wire of claim 1, wherein said oxide insulating layer is formed on said anodic oxide layer by an organic acid salt pyrolytic method.

7. The insulated electrical wire of claim 6, wherein said conductor core is made of a material selected from the group consisting of copper and copper alloys.

8. The insulated electrical wire of claim 7, wherein said surface layer on said conductor core is prepared by a pipe cladding method.

9. The insulated electrical wire of claim 6, wherein said oxide insulating layer is made of at least one member selected from the group consisting of silicon oxide and aluminum oxide.

10. The insulated electrical wire of claim 1, wherein said oxide insulating layer is formed by applying a solution containing a ceramics precursor, onto said anodic oxide layer and thereafter completely bringing said ceramics precursor to a ceramic state.

* * * * *